US010269239B2

(12) United States Patent
Brady et al.

(10) Patent No.: US 10,269,239 B2
(45) Date of Patent: Apr. 23, 2019

(54) PEDESTRIAN CROSSING AND/OR TRAFFIC LIGHT CONTROL METHOD AND APPARATUS

(71) Applicant: Intel Corporation, Santa Clara, CA (US)

(72) Inventors: Kevin Brady, Banbridge (IE); Ruben Trejo Calle, Dublin (IE); Jelle Sels, Dublin (IE); Diarmaid O'Cualain, Indreabhan (IE); Aziz Bahri, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/661,801

(22) Filed: Jul. 27, 2017

(65) Prior Publication Data

US 2019/0035262 A1 Jan. 31, 2019

(51) Int. Cl.
*G08G 1/005* (2006.01)

(52) U.S. Cl.
CPC ..... *G08G 1/005* (2013.01)

(58) Field of Classification Search
CPC ..... G08G 1/005; G08G 1/07; B61L 13/00; B61L 2205/04; B61L 25/025
See application file for complete search history.

(56) References Cited

U.S. PATENT DOCUMENTS 7,864,072 B2 1/2011 Basson et al.
8,462,017 B2 6/2013 Sennett et al.
9,483,937 B2 11/2016 Todasco
9,576,479 B2 2/2017 Kvetny et al.
2009/0146841 A1* 6/2009 Basson ..... G08G 1/005 340/925
2011/0148660 A1* 6/2011 Tate ..... G08G 1/005 340/906

(Continued)

OTHER PUBLICATIONS

University of Connecticut. School of Engineering. The When, Where and How of Mid-Block Crosswalks. Tech Brief Mar. 2014, 6 pages.

(Continued)

*Primary Examiner* — Orlando Bousono
(74) *Attorney, Agent, or Firm* — Schwabe, Williamson & Wyatt, P.C.

(57) ABSTRACT

Apparatuses, methods and storage media associated with controlling a pedestrian crossing or traffic light are disclosed herein. In embodiments, an apparatus may include a control unit to extend a duration of a pedestrian crossing state of the pedestrian crossing or traffic light in response to receipt of sensor data that convey detection of at least one commence crossing event of the pedestrian, while the pedestrian crossing or traffic light is in a pedestrian crossing state, but yet to receive sensor data that convey detection of all corresponding end of crossing event or events of the one or more pedestrians, prior to expiration of the duration of the pedestrian crossing state. The controller may extend the duration of the pedestrian crossing state until receipt of sensor data that convey receipt of all corresponding end of crossing event/events of the one or more pedestrians, or until a timeout threshold is reached.

20 Claims, 7 Drawing Sheets

(56) References Cited

U.S. PATENT DOCUMENTS

| | | | | |
|---|---|---|---|---|
| 2012/0223843 | A1* | 9/2012 | Wall | G08G 1/095 340/944 |
| 2014/0306836 | A1* | 10/2014 | Tate | G08G 1/005 340/925 |
| 2014/0346284 | A1* | 11/2014 | Fries | B61L 13/00 246/125 |
| 2015/0228195 | A1* | 8/2015 | Beaurepaire | G08G 1/0962 340/907 |
| 2017/0306577 | A1* | 10/2017 | Trifan | G08G 1/005 |
| 2018/0025633 | A1* | 1/2018 | Tate | G08G 1/005 340/925 |

OTHER PUBLICATIONS

Siemens. Sitraffic Smart Detection. Retrieved on Jul. 27, 2017 from URL «https://www.siemens.com/global/en/home/products/mobility/road-solutions/traffic-management/on-the-road/smart-detection.html» 8 pages.

* cited by examiner

PEDESTRIAN CROSSING AND/OR TRAFFIC LIGHT CONTROL METHOD AND APPARATUS

TECHNICAL FIELD

The present disclosure relates to the field of infrastructure technology, in particular, to apparatuses, methods and storage media associated with controlling a pedestrian crossing and/or traffic light.

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

Current pedestrian crossing lights often provide a visual count down or an audio signal to indicate the remaining time a pedestrian has to cross a pedestrian crossway. Traffic light manufacturers and traffic management vary with respect to the time-to-cross for pedestrians. This can depend on the time set at installation, or based on traffic conditions. The current approach potentially presents a risk to the safety of those who are visually impaired, elderly or physically challenged.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
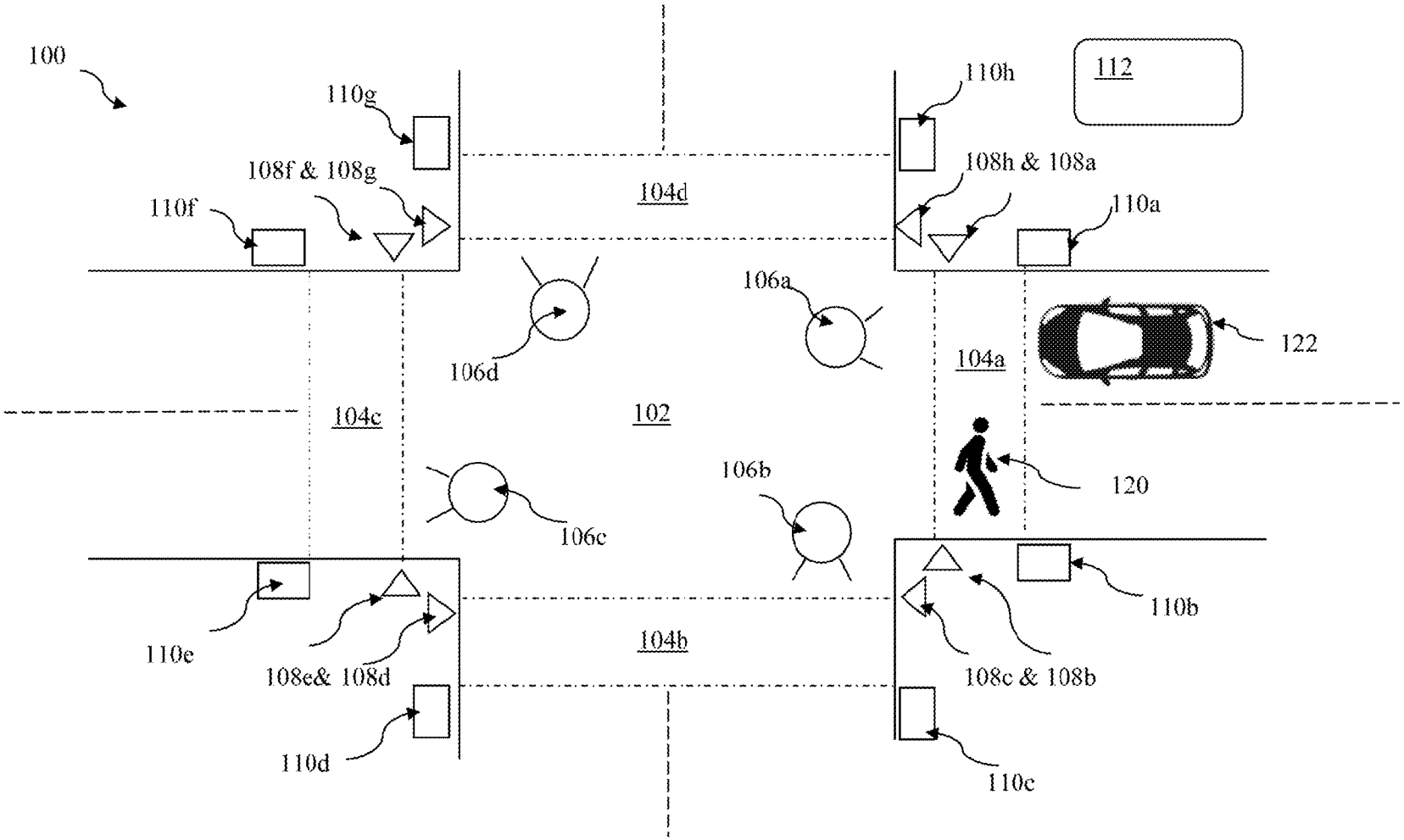
FIG. 1 illustrates an overview of an example system for controlling a pedestrian crossing and/or traffic light, in accordance with various embodiments.

Apparatuses, methods and storage media associated with controlling a pedestrian crossing or traffic light are disclosed herein. In embodiments, an apparatus may include a control unit to extend a duration of a pedestrian crossing state of the pedestrian crossing or traffic light in response to receipt of sensor data that convey detection of at least one commence crossing event of the pedestrian, while the pedestrian crossing or traffic light is in a pedestrian crossing state, but yet to receive sensor data that convey detection of all corresponding end of crossing event or events of the one or more pedestrians, prior to expiration of the duration of the pedestrian crossing state. The controller may extend the duration of the pedestrian crossing state until receipt of sensor data that convey receipt of all corresponding end of crossing event or events of the one or more pedestrians, or until a timeout threshold is reached. Other embodiments may be disclosed or claimed.

In embodiments, the control unit may further comprise a communication interface to receive the sensor data from one or more sensors, the sensor data to convey detection of the one or more commence crossing events of the one or more pedestrians or one or more end of crossing events of the one or more pedestrians crossing over a pedestrian crosswalk. In embodiments, the apparatus may further include the one or more sensors, and/or the pedestrian crossing or traffic light. In embodiments, the apparatus may be disposed at a crossing point of a street, which may be at a street junction.

In the description to follow, reference is made to the accompanying drawings, which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Operations of various methods may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiments. Various additional operations may be performed and/or described operations may be omitted, split or combined in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

As used hereinafter, including the claims, the term "module" may refer to, be part of, or include an Application Specific Integrated Circuit (ASIC), an electronic circuit, a programmable combinational logic circuit (e.g., field programmable gate arrays (FPGA)), a processor (shared, dedicated, or group) and/or memory (shared, dedicated, or group) that execute one or more software or firmware programs generated from a plurality of programming instructions and/or other suitable components that provide the described functionality.

Referring now FIG. 1, wherein an overview of an example system for controlling a pedestrian crossing or traffic light, in accordance with various embodiments, is shown. As illustrated, for the embodiments, example system 100 for controlling a pedestrian crossing or traffic light, any one of traffic lights 106*a*-106*d*, or pedestrian crossing lights 108*a*-108*h*, at example junction 102, may include sensors 110*a*-110*h* and pedestrian crossing or traffic light control unit 112. In particular, control unit 112 may be provided with the pedestrian crossing duration control technology of the present disclosure to control the duration of the pedestrian crossing state of traffic lights 106*a*-106*d*, or pedestrian crossing lights 108*a*-108*h*, to assist a pedestrian, e.g., pedestrian 120, in crossing a pedestrian crosswalk, e.g., pedestrian crosswalk 104*a*, based at least in part on the sensor data provided by sensors 110*a*-110*h*.

In example junction 102, traffic lights 106*a*-106*d* may be provided to control the flow of vehicles, e.g., example vehicle 122, from the various directions, going through junction 102. In example junction 102, pedestrian crossing lights 108*a*-108*d* may also be provided to regulate and/or assist pedestrians, e.g., pedestrian 120, in crossing pedestrian crosswalks 104*a*-104*d*. For the embodiments, the duration of the pedestrian crossing state of pedestrian crossing lights 108*a*-108*d* and/or traffic lights 106*a*-106*d* may be controlled by control unit 112.

The term "pedestrian crossing state" as used herein refers to the light state of a pedestrian crossing light 108*a*-108*d* and/or traffic light 106*a*-106*d* during which a pedestrian may safely cross an associated pedestrian crosswalk 104*a*-104*d*. For example, the pedestrian crossing state for pedestrian crossing light 108*a*, associated with pedestrian crosswalk 104*a*, is when pedestrian crossing light 108*a* in the light state of "Walk." For pedestrian crosswalk 104*a*, pedestrian crossing light 108*a* is not in the "pedestrian crossing state," when pedestrian crossing light 108*a* is in the light state of "Do Not Walk." In the cases of traffic light 106*a* and 106*c*, they are in the pedestrian crossing state (for pedestrian crosswalk 104*a*) when traffic light 106*a* and 106*c* are "red," and not in the "pedestrian crossing state" (for pedestrian crosswalk 104*a*) when traffic light 106*a* and 106*c* are "yellow or green." However, for traffic light 106*b* and 106*d*, they are in the "pedestrian crossing state" (for pedestrian crosswalk 104*a*) when traffic light 106*b* and 106*d* are "green," and not in the pedestrian crossing state (for pedestrian crosswalk 104*a*) when traffic light 106*a* and 106*c* are "yellow or red." While traffic light 106*a* and 106*c* is in the "pedestrian crossing state" for pedestrian crosswalk 104*a*, they are also in "pedestrian crossing state" for pedestrian crosswalk 104*c*, but they are not in "pedestrian crossing state" for pedestrian crosswalks 104*b* and 104*d*.

Still referring to FIG. 1, sensors 110*a*-110*h* may be provided to detect for commence crossing events and end of cross events of pedestrians crossing pedestrian crossways 104*a*-104*d*. More specifically, sensors 110*a*-110*h* may be provided to sense and output sensor data that directly or indirectly convey detection of commence crossing events and end of cross events of pedestrians crossing pedestrian crossways 104*a*-104*d*. In embodiments, sensors 110*a*-110*h* may include RFID readers, to sense RFID tags of pedestrians 120, and in response output sensor data that denote commence crossing events and end of cross events of pedestrians 120. In alternate embodiments, sensors 110*a*-110*h* may include near field communication (NFC) receivers, to receive signals from NFC transmitters of pedestrians 120, and in response output sensor data that denote commence crossing events and end of cross events of pedestrians 120. In still other embodiments, sensors 110*a*-110*h* may include cameras to capture and output image frames of pedestrians crosswalks 104*a*-104*d* to allow commence crossing events and end of cross events of pedestrians 120 over pedestrians crosswalks 104*a*-104*d* to be discerned. These are non-limiting illustrative examples. In alternate embodiments, other sensors may also be used. In embodiments, combinations of sensors of different types may be employed.

Further, while for ease of understanding, one each of sensors 110*a*-110*h* is shown as disposed at each end of a pedestrian crosswalk 104*a*-104*d*, in embodiments, depending on the types of sensors employed, e.g., when camera is used, the sensor may be disposed at other locations, away from crosswalks 104*a*-104*d*, and each sensor 110*a*-110*h* may serve more than one end of a pedestrian crosswalk 104*a*-104*d*.

Figure 2:
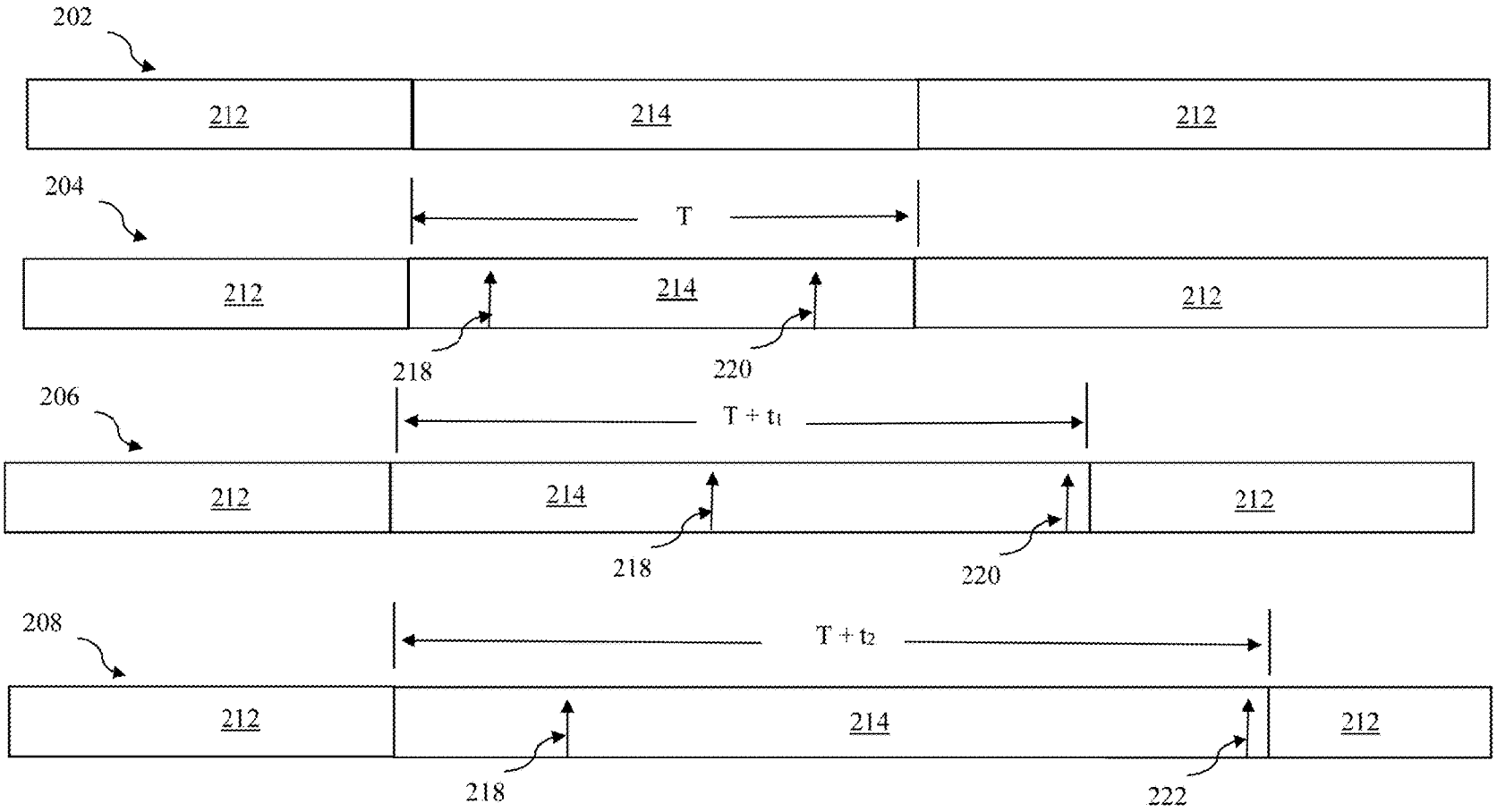
FIG. 2 illustrates an example controlling of pedestrian crossing and/or traffic light, in accordance with various embodiments.

Control unit 112 may be configured to control pedestrian crossing lights 108*a*-108*d* and/or traffic lights 106*a*-106*d*, based at least in part on the detections of the commence crossing events and end of cross events of pedestrians 120 (or lack of). Referring now also to FIG. 2, wherein an example controlling of pedestrian crossing and/or traffic light, based at least in part on the detections of the commence crossing events and end of cross events of pedestrians 120 (or lack of), in accordance with various embodiments, is shown. As illustrated, for the embodiments, control unit 112 may be configured to control pedestrian crossing lights 108*a*-108*d* and/or traffic lights 106*a*-106*d*, based at least in part on the detections of the commence crossing events and end of cross events of pedestrians 120 (or lack of), in accordance with one of the four illustrated scenarios 202-208.

Under scenario 202, where neither commence crossing events and end of crossing events of pedestrians 120 are detected for a pedestrian crosswalk 104*a*-104*d* during a pedestrian crossing duration time T (e.g., a preset, default or scheduled duration), after a pedestrian crossing light 108*a*-108*d* associated with pedestrian crosswalk 104*a*-104*d*, and/or traffic lights 106*a*-106*d* having impact on the pedestrian crosswalk 104*a*-104*d* transitioned into the pedestrian crossing state 214, the pedestrian crossing light 108*a*-108*d* and/or traffic lights 106*a*-106*d* may transition from the pedestrian crossing state 214 back to the non-pedestrian crossing state 212, after expiration of the (preset, default or scheduled) duration time T.

Under scenario 204, where at least one commence crossing event and all corresponding end of crossing event or events of pedestrians 120 are detected for a pedestrian crosswalk 104*a*-104*d* during a pedestrian crossing duration time T (e.g., a preset, default or scheduled duration), after a pedestrian crossing light 108*a*-108*d* associated with the pedestrian crosswalk 104*a*-104*d*, and/or traffic lights 106*a*-106*d* having impact on the pedestrian crosswalk 104*a*-104*d* transitioned into the pedestrian crossing state 214, the pedestrian crossing light 108*a*-108*d* and/or traffic lights 106*a*-106*d* may similarly transition from the pedestrian crossing state 214 back to the non-pedestrian crossing state 212, after expiration of the (preset, default or scheduled) duration time T.

Under scenario 206, where at least one commence crossing event, but not all corresponding end of crossing events of pedestrians 120 are detected for a pedestrian crosswalk 104*a*-104*d* during a pedestrian crossing duration time T (e.g., a preset, default or scheduled duration), after a pedestrian crossing light 108*a*-108*d* associated with the pedestrian crosswalk 104*a*-104*d*, and/or traffic lights 106*a*-106*d* having impact on the pedestrian crosswalk 104*a*-104*d* transitioned into the pedestrian crossing state 214, the pedestrian crossing light 108*a*-108*d* and/or traffic lights 106*a*-106*d* may extend the crossing duration by an additional amount of time $t_1$. And on detection of all corresponding end of crossing events of pedestrians 120 prior to the expiration of the duration $T+t_1$, transition from the pedestrian crossing state 214 back to the non-pedestrian crossing state 212, after expiration of the extended duration time $T+t_1$.

Under scenario 208, where at least one commence crossing event, but not all corresponding end of crossing events of pedestrians 120 are detected for a pedestrian crosswalk 104*a*-104*d* during an extended pedestrian crossing duration time $T+t_1$, after a pedestrian crossing light 108*a*-108*d* associated with the pedestrian crosswalk 104*a*-104*d*, and/or traffic lights 106*a*-106*d* having impact on the pedestrian crosswalk 104*a*-104*d* transitioned into the pedestrian crossing state 214, the pedestrian crossing light 108*a*-108*d* and/or traffic lights 106*a*-106*d* may nonetheless transition from the pedestrian crossing state 214 back to the non-pedestrian crossing state 212, after reaching a maximum duration time $T+t_2$ (which may also referred to as a time out threshold or a time out event).

Referring back to FIG. 1, for the embodiments, control unit 112 may be proximally located at junction 102 where pedestrian crossing lights 108*a*-108*d* and/or traffic lights 106*a*-106*d* are located. Control unit 112 may be physically coupled, e.g., via hard wires (not shown) or wirelessly coupled with pedestrian crossing lights 108*a*-108*d* and/or traffic lights 106*a*-106*d*. In alternate embodiments, control unit 112 may be remotely disposed away from, and communicatively coupled with pedestrian crossing lights 108*a*-108*d* and/or traffic lights 106*a*-106*d*, via one or more wired and/or wireless communication networks (not shown).

Further, while for ease of understanding, system 100 for controlling a pedestrian crossing or traffic light has been illustrated the context of street junction, in alternate embodiments, system 100 may be implemented for controlling a pedestrian crossing light of a pedestrian crossing, at any point of a street (e.g., in the middle), in between two cross streets.

Figure 3:
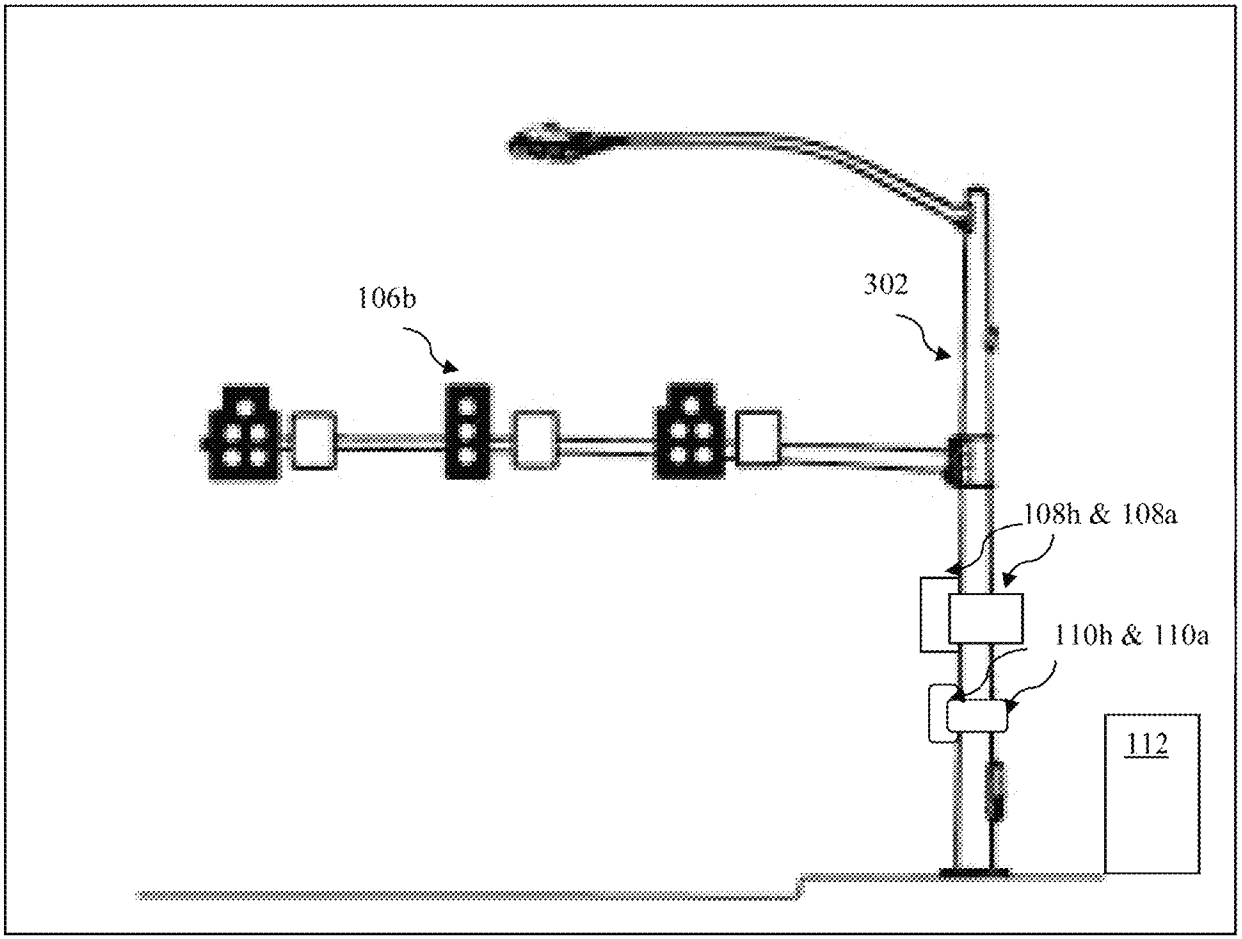
FIG. 3 illustrates an example arrangement of the pedestrian crossing and traffic light, in accordance with various embodiments.

Referring now to FIG. 3, wherein an example arrangement of a pedestrian crossing and traffic light, in accordance with various embodiments, is illustrated. As shown, for the embodiments, a traffic light, e.g. traffic light 106*b*, pedestrian crossing lights 108*a* and 108*h*, and sensors 110*a* and 110*h* may be arranged to be disposed on the same utility pole 302, e.g., a street lamppost. For the embodiments, control unit 112 may be proximally located near utility pole 302.

Figure 4:
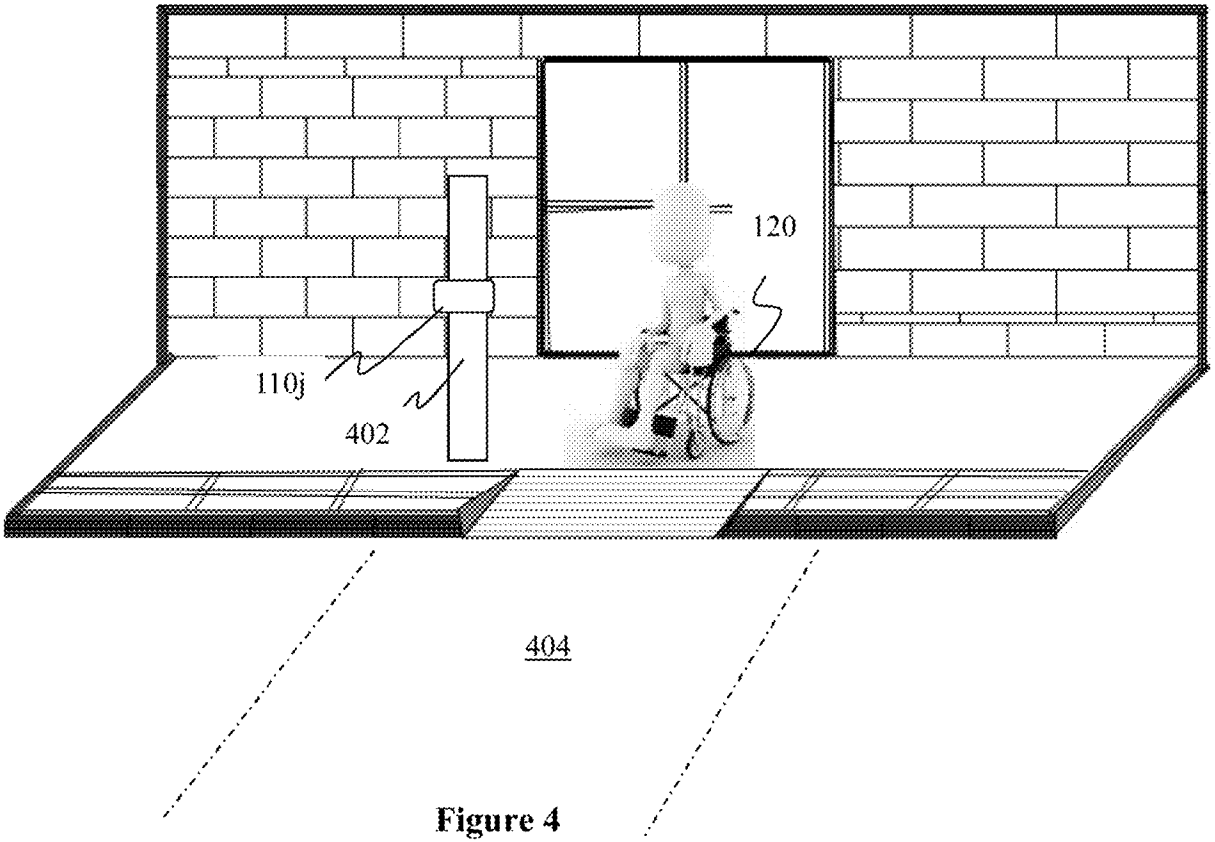
FIG. 4 illustrates another example arrangement of the pedestrian crossing and traffic light, in accordance with various embodiments.

Referring to FIG. 4, wherein another arrangement of the pedestrian crossing and traffic light, in accordance with various embodiments, is illustrated. Similarly, a control unit (not shown) may be proximally located near pole 402.

Figure 5:
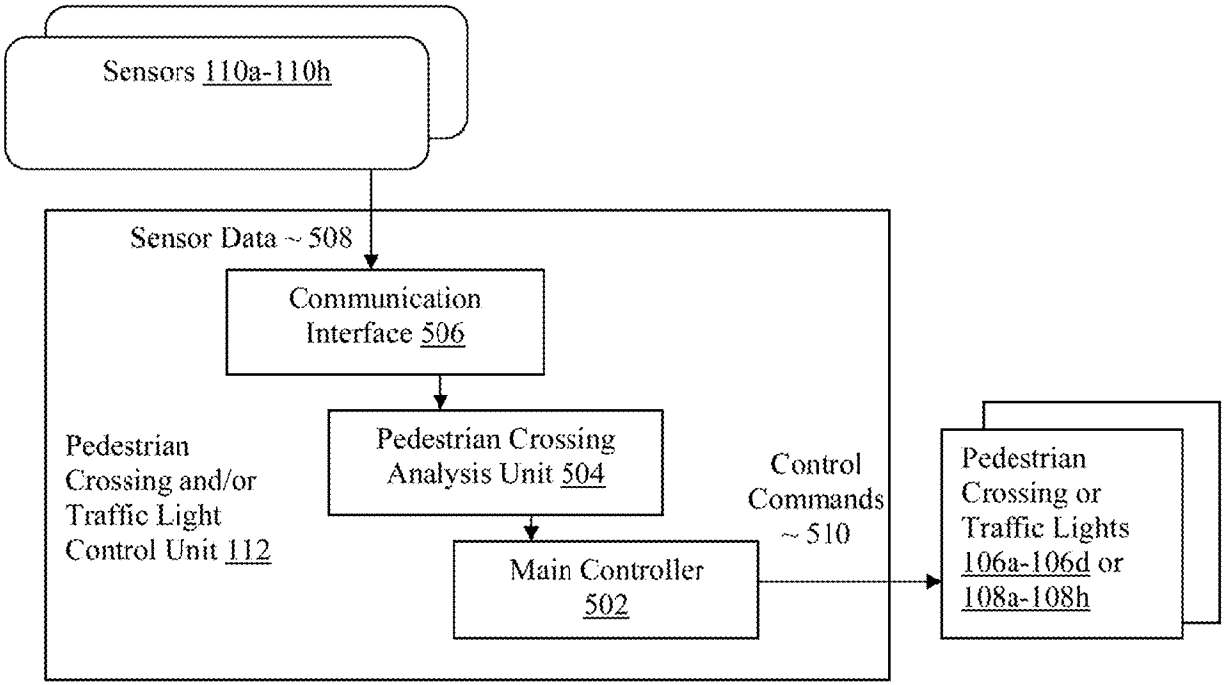
FIG. 5 illustrate a block diagram view of an example pedestrian crossing and/or traffic light control unit, in accordance with various embodiments.

Referring now to FIG. 5, a block diagram view of an example pedestrian crossing and/or traffic light control unit, in accordance with various embodiments, is illustrated. As shown, for the embodiments, an example pedestrian crossing and/or traffic light control unit 112 may include main controller 502, pedestrian crossing analysis unit 504, and communication interface 506, coupled with each other. Communication interface 506 may be configured to receive sensor data 508 from the plurality of sensors 108*a*-108*h*, and provide the sensor data to pedestrian crossing analysis unit 504. Pedestrian crossing analysis unit 504 may be configured to analyze the sensor data for detection of commence crossing events and end of crossing events of pedestrians of the various pedestrian crosswalks whose pedestrian crossing or traffic lights 106*a*-106*d* and 108*a*-108*h* are being managed. Main controller 502 may be configured to provide pedestrian crossing or traffic lights 106*a*-106*d* and 108*a*-108*h* with control commands 510, based at least in part on the results of the analysis of the sensor data for detection of commence crossing events and end of crossing events of pedestrians of the various pedestrian crosswalks, provided by pedestrian crossing analysis unit 504.

In embodiments, communication interface 506 may be any one of a number of known wired and/or wireless communication interfaces, including but are not limited to, Ethernet, Universal Serial Bus, Bluetooth®, WiFi, and so forth. Pedestrian crossing analysis unit 504 and main controller 502 may be implemented in hardware, e.g., ASIC, or programmable combinational logic circuit (e.g., (FPGA)), or software (to be executed by a processor and memory arrangement), or combination thereof.

Figure 6:
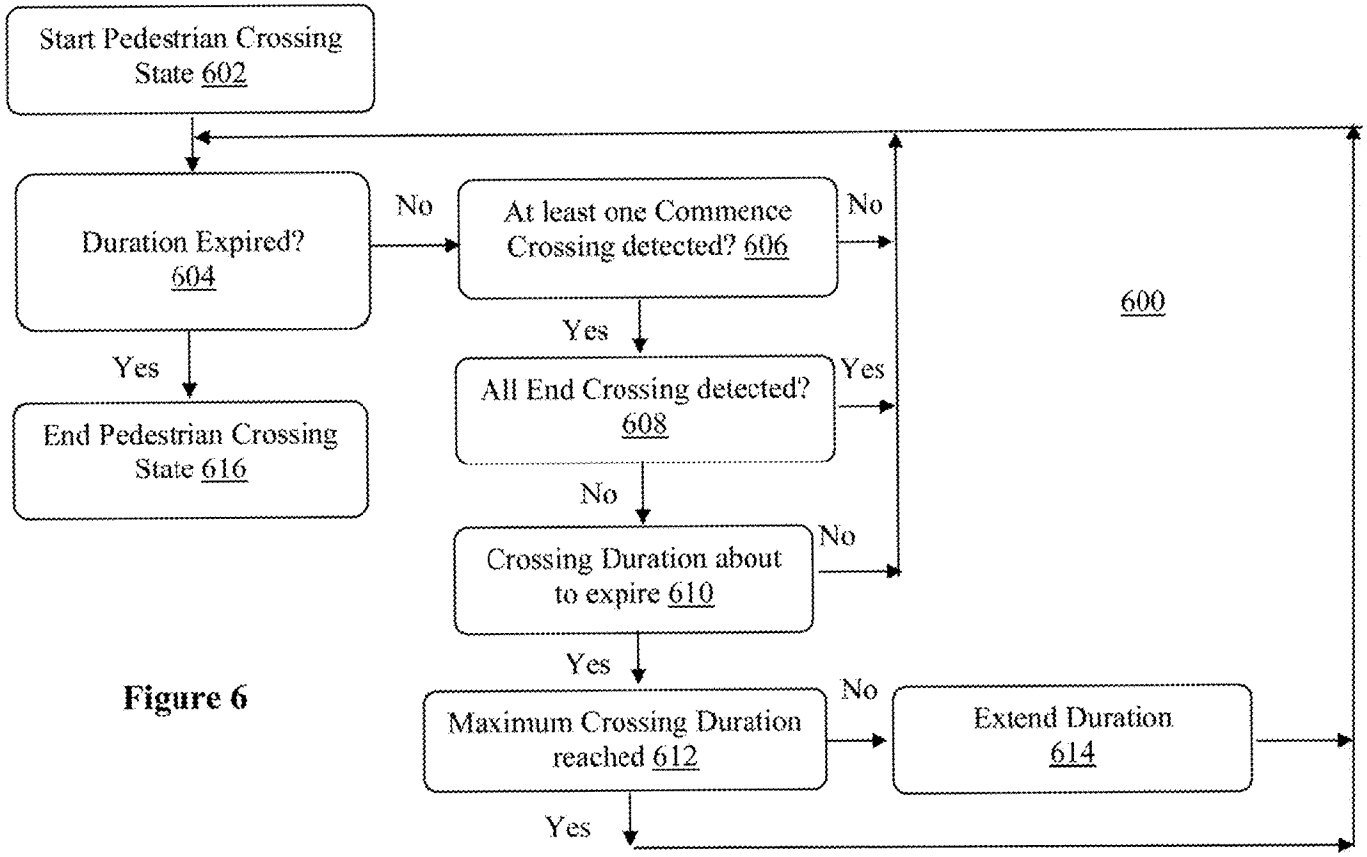
FIG. 6 illustrates an example process for controlling a pedestrian crossing and traffic light, in accordance with various embodiments.

Referring now FIG. 6, wherein an example process for controlling a pedestrian crossing and traffic light, in accordance with various embodiments, is illustrated. As shown, process 600 for controlling a pedestrian crossing and traffic light may include operations performed at blocks 602-616. The operations may be performed e.g., by pedestrian crossing analysis unit 504 of FIG. 5.

Process 600 may start at block 602. At block 602, a pedestrian crossing state may be entered for a pedestrian crossing or traffic light. Next, at block 604, a determination may be made on whether a duration of the pedestrian crossing state (e.g., a preset, default or scheduled duration) has expired. If the duration of the pedestrian crossing state has not expired, process 600 may proceed to block 606.

At block 606, a determination may be made on whether at least one pedestrian commence crossing event has been detected for the associated pedestrian crosswalk. If the result of the determination is negative, at least one pedestrian commence crossing event has not been detected for the associated pedestrian crosswalk, process 600 may return to block 604, and continue there from as earlier described. On the other hand, if the result of the determination is positive, at least one pedestrian commence crossing event has been detected for the associated pedestrian crosswalk, process 600 may proceed to block 608.

At block 608, a determination may be made on whether all corresponding pedestrian end crossing event or events have been detected for the associated pedestrian crosswalk. If the result of the determination is negative, all corresponding pedestrian end crossing event or events have not been detected for the associated pedestrian crosswalk, process 600 may return to block 604, and continue there from as earlier described. On the other hand, if the result of the determination is positive, all corresponding pedestrian end crossing event or events have been detected for the associated pedestrian crosswalk, process 600 may proceed to block 610.

At block 610, a determination may be made on whether the duration of the pedestrian crossing state for the associated pedestrian crosswalk is about to expire. If the result of the determination is negative, the duration of the pedestrian crossing state for the associated pedestrian crosswalk is not about to expire, process 600 may return to block 604, and continue there from as earlier described. On the other hand, if the result of the determination is positive, the duration of the pedestrian crossing state for the associated pedestrian crosswalk is about to expire, process 600 may proceed to block 612.

At block 612, a determination may be made on whether a maximum crossing duration (time out) has been reached for the associated pedestrian crosswalk. If the result of the determination is negative, the maximum crossing duration (time out) has not been reached for the associated pedestrian crosswalk, process 600 may return to block 614. At block 614, the duration for the pedestrian crossing state of the pedestrian crossing or traffic light may be extended. Thereafter, process 600 may return to block 604, and continue there from as earlier described. Similarly, if a result of the determination at block 612 is positive, the maximum crossing duration (time out) has been reached for the associated pedestrian crosswalk, process 600 may likewise return to block 604, and continue there from as earlier described.

Eventually, a result of the determination at block 604 will indicate expiration of the (extended or max out) duration of the pedestrian crossing state of the pedestrian crossing or traffic light. At such time, process 600 may proceed to block 616. At block 616, the pedestrian crossing or traffic light may transition out of the pedestrian crossing state, with their light state changed accordingly.

Figure 7:
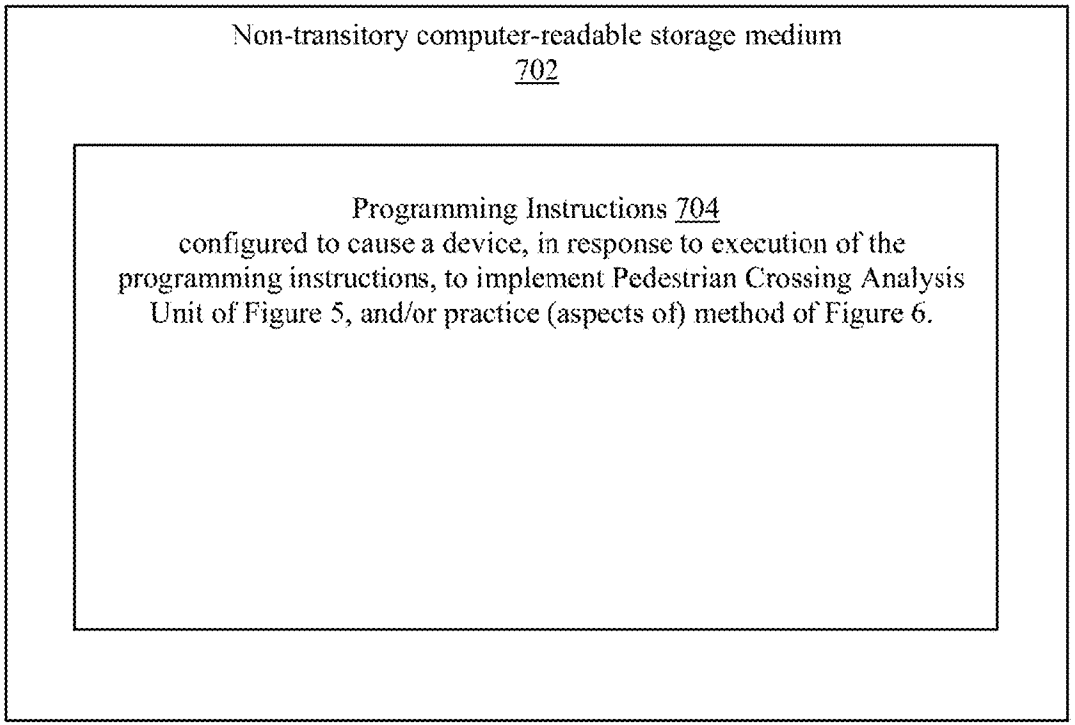
FIG. 7 illustrates an example storage medium with instructions configured to enable a pedestrian crossing and traffic light control unit to practice the present disclosure, in accordance with various embodiments.

FIG. 7 illustrates an example non-transitory computer-readable storage medium having instructions configured to practice all or selected ones of the operations associated with controlling pedestrian crossing or traffic light, earlier described, in accordance with various embodiments. As illustrated, non-transitory computer-readable storage medium 702 may include the executable code of a number of programming instructions 704. Executable code of programming instructions 704 may be configured to enable a device, e.g., pedestrian crossing or traffic light control unit 112, in response to execution of the executable code/programming instructions, to perform, e.g., various operations associated controlling pedestrian crossing or traffic light, described with references to FIGS. 1-6. In alternate embodiments, executable code/programming instructions 704 may be disposed on multiple non-transitory computer-readable storage medium 702 instead. In still other embodiments, executable code/programming instructions 804 may be encoded in transitory computer readable medium, such as signals.

In embodiments, a processor may be packaged together with a computer-readable storage medium having some or all of executable code of programming instructions 704 configured to practice all or selected ones of the operations earlier described with references to FIG. 1-6. For one embodiment, a processor may be packaged together with such executable code 704 to form a System in Package (SiP). For one embodiment, a processor may be integrated on the same die with a computer-readable storage medium having such executable code 704. For one embodiment, a processor may be packaged together with a computer-readable storage medium having such executable code 704 to form a System on Chip (SoC). For at least one embodiment, the SoC may be utilized in, e.g., pedestrian crossing or traffic light control unit 112.

Thus, an improved method and apparatus for controlling pedestrian crossing or traffic light has been described. The approach may be especially helpful for pedestrian who are visually impaired, elderly or physically challenged, needing more time to cross a pedestrian crosswalk.

Example 1 may be an apparatus for controlling a pedestrian crossing or traffic light, comprising: a communication interface to receive sensor data from one or more sensors, the sensor data to convey detection of one or more commence crossing events of one or more pedestrians or one or more end of crossing events of the one or more pedestrians crossing over a pedestrian crosswalk; and a controller coupled to the communication interface to extend a duration of a pedestrian crossing state of the pedestrian crossing or traffic light in response to receipt of sensor data that convey detection of at least one commence crossing event of the pedestrian, while the pedestrian crossing or traffic light is in the pedestrian crossing state, but yet to receive sensor data that convey detection of all corresponding end of crossing event or events of the one or more pedestrians, prior to expiration of the duration of the pedestrian crossing state; wherein the controller may extend the duration of the pedestrian crossing state until receipt of sensor data that convey receipt of all corresponding end of crossing event or events of the one or more pedestrians, or until a timeout threshold is reached.

Example 2 may be example 1, wherein the controller may allow the pedestrian crossing state of the pedestrian crossing or traffic light to terminate at the end of the duration without extension, in response to receipt of sensor data that convey detection of all corresponding end of crossing event or events of the one or more pedestrians during the pedestrian crossing state, prior to the expiration of the duration.

Example 3 may be example 1, wherein the controller may allow the pedestrian crossing state of the pedestrian crossing or traffic light to terminate, after the timeout threshold is reached, even though sensor data that convey detection of all corresponding end of crossing event or events of the one or more pedestrians have not been received prior to the expiration of the extended duration.

Example 4 may be example 1, wherein the one or more sensors may comprise one or more RFID readers, one or more cameras, or one or more near field communication transmitters or receivers.

Example 5 may be example 1, wherein the one or more sensors are proximately located at one or more ends of the pedestrian crossway.

Example 6 may be example 5, wherein the one or more sensors are disposed in one or more poles proximately located at the one or more ends of the pedestrian crossway.

Example 7 may be any one of examples 1-6, further comprising the plurality of sensors.

Example 8 may be any one of examples 1-6, wherein the pedestrian crossing or traffic light and the pedestrian crossway are located at a street junction, and the communication interface and the controller are proximately located at the same junction, near the pedestrian crossing or traffic light and the pedestrian crosswalk.

Example 9 may be any one of examples 1-6, wherein the pedestrian crossing or traffic light is a pedestrian crossing light, jointly located with the pedestrian crossway at a crossing point of a street, and the communication interface and the controller are proximately located on the same street.

Example 10 may be any one of examples 1-6, wherein the communication interface and the controller are disposed at a location remote from the pedestrian crossing or traffic light and the pedestrian crosswalk.

Example 11 may be any one of examples 1-6, further comprising the pedestrian crossing or traffic light.

Example 12 may be a method for controlling a pedestrian crossing or traffic light, comprising: receiving from one or more sensors, by a pedestrian crossing or traffic light control unit, sensor data conveying detection of one or more commence crossing events of one or more pedestrians or one or more end of crossing events of the one or more pedestrian crossing over a pedestrian crosswalk; and extending, by a pedestrian crossing or traffic light controller, a duration of a pedestrian crossing state of the pedestrian crossing or traffic light, in response to receipt of sensor data that convey detection of at least one commence crossing event of the one or more pedestrians, while the pedestrian crossing or traffic light is in the pedestrian crossing state, but yet to receive sensor data that convey detection of all corresponding end of crossing event or events of the one or more pedestrians, prior to expiration of the duration of the pedestrian crossing state.

Example 13 may be example 12, wherein extending may comprise extending the duration of the pedestrian crossing state until receipt of sensor data that convey detection of all corresponding end of crossing event or events of the one or more pedestrians, or until a timeout threshold is reached.

Example 14 may be example 13, wherein extending may comprise allowing, by the controller, the pedestrian crossing state of the pedestrian crossing or traffic light to terminate at the end of the duration without extension, in response to receipt of sensor data that convey detection of all corresponding end of crossing event or events of the one or more pedestrians during the pedestrian crossing state, prior to the expiration of the duration.

Example 15 may be example 13, wherein extending may comprise allowing, by the controller, the pedestrian crossing state of the pedestrian crossing or traffic light to terminate, after the timeout threshold is reached, even though sensor data that convey detection of all corresponding end of crossing event or events of the one or more pedestrians have not been received prior to the expiration of the extended duration.

Example 16 may be at least one computer readable media (CRM) comprising a plurality of instructions arranged to cause a pedestrian crossing or traffic light controller, in response to execution of the instructions the pedestrian crossing or traffic light controller, to: extend a duration of a pedestrian crossing state of the pedestrian crossing or traffic light, in response to receipt of sensor data that convey detection of one or more commence crossing events of one or more pedestrians crossing over a pedestrian crosswalk, while the pedestrian crossing or traffic light is in a pedestrian crossing state, but sensor data that convey detection of all corresponding end of crossing event or events of the one or more pedestrians are yet to be received, prior to expiration of the duration of the pedestrian crossing state; wherein to extend may comprise to extend the duration of the pedestrian crossing state until receipt of sensor data that convey detection of all corresponding end of crossing event or events of the one or more pedestrians, or until a timeout threshold is reached.

Example 17 may be example 16, wherein the pedestrian crossing or traffic light controller is further caused to receive from one or more sensors, the sensor data that convey detection of the one or more commence crossing events of the one or more pedestrians or the one or more end of crossing events of the one or more pedestrians crossing over the pedestrian crosswalk.

Example 18 may be example 16 or 17, wherein to extend may comprise to allow the pedestrian crossing state of the pedestrian crossing or traffic light to terminate at the end of the duration without extension, in response to receipt of sensor data that convey detection of all corresponding end of crossing event or events of the one or more pedestrians during the pedestrian crossing state, prior to the expiration of the duration.

Example 19 may be example 16 or 17, wherein to extend may comprise to allow the pedestrian crossing state of the pedestrian crossing or traffic light to terminate, after the timeout threshold is reached, even though sensor data that convey detection of all corresponding end of crossing event or events of the one or more pedestrians have not been received prior to the expiration of the extended duration.

Example 20 may be a system for controlling a pedestrian crossing or traffic light, comprising: a plurality of sensors to generate sensor data that conveys detection of one or more commence crossing events of one or more pedestrians or detection of one or more corresponding end of crossing event or events of one or more pedestrians; crossing a pedestrian crossway; and means for extending a duration of a pedestrian crossing state of the pedestrian crossing or traffic light, in response to receipt from the plurality of sensors, sensor data that convey detection of the one or more commence crossing events of the one or more pedestrians, while the pedestrian crossing or traffic light is in the pedestrian crossing state, but yet to receive from the plurality of sensors, sensor data that convey detection of all corresponding end of crossing event or events of the one or more pedestrians, prior to expiration of the duration of the pedestrian crossing state.

Example 21 may be example 20, wherein means for extending may comprise means for extending the duration of the pedestrian crossing state until receipt of sensor data that convey detection of all corresponding end of crossing event or events of the one or more pedestrians, or until a timeout threshold is reached.

Example 22 may be example 21, wherein means for extending may comprise means for allowing the pedestrian crossing state of the pedestrian crossing or traffic light to terminate at the end of the duration without extension, in response to receipt of sensor data that convey detection of all corresponding end of crossing event or events of the one or more pedestrians during the pedestrian crossing state, prior to the expiration of the duration.

Example 23 may be example 21, wherein means for extending may comprise means for allowing the pedestrian crossing state of the pedestrian crossing or traffic light to terminate, after the timeout threshold is reached, even though sensor data that convey detection of all corresponding end of crossing event or events of the one or more pedestrians have not been received prior to the expiration of the extended duration.

Example 24 may be example 20, wherein the one or more sensors comprise one or more RFID readers, one or more cameras, or one or more near field communication transmitters or receivers.

Example 25 may be example 20, wherein the one or more sensors are proximately located at one or more ends of the pedestrian crossway.

Example 26 may be example 25, wherein the one or more sensors are disposed in one or more poles proximately located at the one or more ends of the pedestrian crossway.

Example 27 may be any one of examples 20-26, wherein the pedestrian crossing or traffic light and the pedestrian crossway are located at a street junction, and the communication interface and the controller are proximately located at the same junction, near the pedestrian crossing or traffic light and the pedestrian crosswalk.

Example 28 may be any one of examples 20-26, wherein the pedestrian crossing or traffic light is a pedestrian crossing light, jointly located with the pedestrian crossway at a crossing point of a street, and the communication interface and the controller are proximately located on the same street.

Example 29 may be any one of examples 20-26, wherein the means for extending is disposed at a location remote from the pedestrian crossing or traffic light and the pedestrian crosswalk.

Example 30 may be any one of examples 20-26, further comprising the pedestrian crossing or traffic light.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims.

Where the disclosure recites "a" or "a first" element or the equivalent thereof, such disclosure includes one or more such elements, neither requiring nor excluding two or more such elements. Further, ordinal indicators (e.g., first, second or third) for identified elements are used to distinguish between the elements, and do not indicate or imply a required or limited number of such elements, nor do they indicate a particular position or order of such elements unless otherwise specifically stated.

What is claimed is:

1. An apparatus for controlling a pedestrian crossing or traffic light, comprising:

first one or more sensors disposed at a first end of a pedestrian crosswalk to sense one or more pedestrians commence crossing of the pedestrian crosswalk from the first end to a second opposite end of the pedestrian crosswalk, and generate first one or more sensor data respectively representative of the one or more commencements of crossing by the one or more pedestrians;

second one or more sensors disposed at the second end of the pedestrian crosswalk to sense the one or more pedestrians end crossing of the pedestrian crosswalk, and generate second one or more sensor data respectively representative of the end of crossing of the one or more pedestrians; and a pedestrian crossing or traffic light control unit having:

a communication interface to receive the first and second one or more sensor data from the first and second one or more sensors; and a controller coupled to the communication interface to extend a duration of a pedestrian crossing state of the pedestrian crossing or traffic light in response to receipt of the first one or more sensor data, while the pedestrian crossing or traffic light is in the pedestrian crossing state, but yet to receive the second one or more sensor data for all one or more pedestrians commenced crossing, prior to expiration of the duration of the pedestrian crossing state; wherein the controller is to extend the duration of the pedestrian crossing state until receipt of the second one or more sensor data for all one or more pedestrians commenced crossing, unless a timeout threshold is reached.

2. The apparatus of claim 1, wherein the controller is to allow the pedestrian crossing state of the pedestrian crossing or traffic light to terminate at the end of the duration without extension, in response to receipt of the second one or more sensor data for all one or more pedestrians commenced crossing during the pedestrian crossing state, prior to the expiration of the duration.

3. The apparatus of claim 1, wherein the controller is to allow the pedestrian crossing state of the pedestrian crossing or traffic light to terminate, after the timeout threshold is reached, even though the second one or more sensor data for all one or more pedestrians commenced crossing have not been received prior to the expiration of the extended duration.

4. The apparatus of claim 1, wherein the first or second one or more sensors comprise one or more radio frequency identification (RFID) readers, or one or more near field communication sensors.

5. The apparatus of claim 1, wherein the first and second one or more sensors are respectively disposed in a first and a second pole respectively located at the first and second ends of the pedestrian crosswalk.

6. The apparatus of claim 1, wherein the one or more pedestrians are first one or more pedestrians; the second one or more sensors further sense second one or more pedestrians commence crossing the pedestrian crosswalk from the second end to the first end, and generate third one or more sensor data respectively representative of the commencement of crossing of the second one or more pedestrians; the first one or more sensors further sense the second one or more pedestrians ending crossing of the pedestrian crosswalk, and generate fourth one or more sensor data respectively representative of the one or more ending of crossing by the second one or more pedestrians; the communication interface further receives the third and fourth one or more sensor data; and the controller extends the duration of the pedestrian crossing state of the pedestrian crossing or traffic light in response to receipt of the third one or more sensor data, while the pedestrian crossing or traffic light is in the pedestrian crossing state, but yet to receive the fourth one or more sensor data for all second one or more pedestrians commenced crossing, prior to expiration of the duration of the pedestrian crossing state; wherein the controller is to extend the duration of the pedestrian crossing state until receipt of the fourth one or more sensor data for all second one or more pedestrians commenced crossing, unless the timeout threshold is reached.

7. The apparatus of claim 1, wherein the pedestrian crossing or traffic light and the pedestrian crosswalk are located at a street junction, and the communication interface and the controller are proximately located at the same junction, near the pedestrian crossing or traffic light and the pedestrian crosswalk.

8. The apparatus of claim 1, wherein the pedestrian crossing or traffic light is a pedestrian crossing light, jointly located with the pedestrian crosswalk at a crossing point of a street, and the communication interface and the controller are proximately located on the same street.

9. The apparatus of claim 1, wherein the communication interface and the controller are disposed at a location remote from the pedestrian crossing or traffic light and the pedestrian crosswalk.

10. The apparatus of claim 1, further comprising the pedestrian crossing or traffic light.

11. A method for controlling a pedestrian crossing or traffic light, comprising:

sensing with first one or more sensors disposed at a first end of a pedestrian crosswalk one or more pedestrians commence crossing of the pedestrian crosswalk from the first end to a second opposite end of the pedestrian crosswalk, and generating first one or more sensor data respectively representative of the one or more commencements of crossing by the one or more pedestrians;

sensing with second one or more sensors disposed at the second end of the pedestrian crosswalk the one or more pedestrians end crossing of the pedestrian crosswalk, and generating second one or more sensor data respectively representative of the end of crossing of the one or more pedestrians; and receiving from the first and second one or more sensors, by a pedestrian crossing or traffic light control unit, the first and second one or more sensor data; and extending, by the pedestrian crossing or traffic light control unit, a duration of a pedestrian crossing state of the pedestrian crossing or traffic light, in response to receipt of the first one or more sensor data, while the pedestrian crossing or traffic light is in the pedestrian crossing state, but yet to receive the second one or more sensor data for all one or more pedestrians, prior to expiration of the duration of the pedestrian crossing state, unless a timeout threshold is reached.

12. The method of claim 11, wherein extending comprises allowing, by a controller, the pedestrian crossing state of the pedestrian crossing or traffic light to terminate at the end of the duration without extension, in response to receipt of the second one or more sensor data for all one or more pedestrians during the pedestrian crossing state, prior to the expiration of the duration.

13. The method of claim 11, wherein extending comprises allowing, by the control unit, the pedestrian crossing state of the pedestrian crossing or traffic light to terminate, after the timeout threshold is reached, even though the second one or more sensor data for all one or more pedestrians have not been received prior to the expiration of the extended duration.

14. At least one non-transitory computer readable media (CRM) comprising a plurality of instructions arranged to cause a pedestrian crossing or traffic light controller, in response to execution of the instructions by the pedestrian crossing or traffic light controller, to:

receive, from first one or more sensors, first one or more sensor data respectively representative of one or more commencements of crossing of a pedestrian crosswalk by one or more pedestrians, the first one or more sensor data being generated by the first one or more sensors disposed at a first end of the pedestrian crosswalk, in response to sensing by the first one or more sensors the one or more pedestrians commence crossing of the pedestrian crosswalk from the first end to a second opposite end of the pedestrian crosswalk;

receive, from second one or more sensors, second one or more sensor data respectively representative of one or more ends of crossing of the pedestrian crosswalk by the one or more pedestrians, the second one or more sensor data being generated by the second one or more sensors disposed at the second end of the pedestrian crosswalk, in response to sensing by the second one or more sensors the one or more pedestrians end crossing of the pedestrian crosswalk; and extend a duration of a pedestrian crossing state of the pedestrian crossing or traffic light, in response to receipt of the first one or more sensor data, while the pedestrian crossing or traffic light is in the pedestrian crossing state, but not the second one or more sensor data for all one or more pedestrians, prior to expiration of the duration of the pedestrian crossing state, unless a timeout threshold is reached.

15. The non-transitory CRM of claim 14, wherein to extend a duration comprises to allow the pedestrian crossing state of the pedestrian crossing or traffic light to terminate at the end of the duration without extension, in response to receipt of the second one or more sensor data for all one or more pedestrians during the pedestrian crossing state, prior to the expiration of the duration.

16. The non-transitory CRM of claim 14, wherein to extend a duration comprises to allow the pedestrian crossing state of the pedestrian crossing or traffic light to terminate, after the timeout threshold is reached, even though the second one or more sensor data for all one or more pedestrians have not been received prior to the expiration of the extended duration.

17. The non-transitory CRM of claim 14, wherein the first and second one or more sensor data are generated by one or more radio frequency identification (RFID) readers or one or more near field communication sensors.

18. The non-transitory CRM of claim 17, wherein the first and second one or more sensors are disposed in first and second one or more poles proximately located at the first and second ends of the pedestrian crosswalk.

19. The non-transitory CRM of claim 14, wherein the pedestrian crossing or traffic light and the pedestrian crosswalk are located at a street junction, and a communication interface and a controller are proximately located at the same junction, near the pedestrian crossing or traffic light and the pedestrian crosswalk.

20. The non-transitory CRM of claim 14, wherein the pedestrian crossing or traffic light is a pedestrian crossing light, jointly located with the pedestrian crosswalk at a crossing point of a street, and a controller is proximately located on the same street.

* * * * *